United States Patent [19]

Malta

[11] Patent Number: 5,010,798

[45] Date of Patent: Apr. 30, 1991

[54] HANDBELL ANTI-ROLL CLIP

[75] Inventor: Jacob H. Malta, New Britain, Pa.

[73] Assignee: Malmark, Inc., Plumsteadville, Pa.

[21] Appl. No.: 546,369

[22] Filed: Jun. 27, 1990

[51] Int. Cl.[5] ..... G10K 1/07

[52] U.S. Cl. ..... 84/406; 84/453; 116/171

[58] Field of Search ..... 84/406, 453; 116/171

[56] References Cited

U.S. PATENT DOCUMENTS 2,818,829 1/1958 Hendricks ..... 116/171

4,566,400 1/1986 Keenan et al. ..... 84/406

*Primary Examiner*—Lawrence R. Franklin

*Attorney, Agent, or Firm*—Gregory J. Gore

[57] ABSTRACT

An anti-roll hand clip for handbells aids in the support of the handbell when resting on the playing table. The clip is a simple, wire device which attaches to the handle of the handbell and, more particularly, to the circular hand guard portion of the handle. The clip contains two feet which contact the table top providing a stable support. The clip is rotatable around the hand guards so that an angular position of the handbell handle with respect to the table top can be selected and maintained. The clip may be coated with an electrostatic powder coating of vinyl or the like to increase its non-slip quality and for abrasion resistence.

10 Claims, 1 Drawing Sheet

HANDBELL ANTI-ROLL CLIP

FIELD OF THE INVENTION

This invention relates to the field of musical instruments and, more specifically, to handbells.

BACKGROUND OF THE INVENTION

Handbells are typically played by a group of musicians in a choir. Each musician playing two or more handbells, which represent a different note on the musical scale. While performing, the handbell musicians stand behind tables on which the handbells rest when not in use. The handbells rest on the tables either between performances, or during a performance when an individual ringer is assigned more than two handbells. In these situations, it is often that handbells are picked up and put down on the table top during a single performance. The handbells generally rest on their sides with their handles in a substantially horizontal orientation.

When resting on the table, most of the weight of the handbell is placed on the circular mouth of the bell which is its largest diameter. Because the bell mouth is circular and the table top is flat, a problem exists with handbells rolling from one side to another when being picked up and put down during a performance. Furthermore, there is a danger that between performances, the bells may inadvertently be bumped by those around the handbell tables which may cause the handbells to roll from the table and fall to the floor, possibly causing serious damage to the rather delicate instruments.

There is, therefore, a need in the musical arts for a handbell stand which can be conveniently used by handbell musicians while playing the instrument. As well as the need for the convenience and safety, there is also a need for an implement to hold the handle firmly at rest so that the orientation of the handle is consistently presented to the ringer to facilitate a quick grasp and release of the instrument as it is being picked up and put down during a performance.

SUMMARY OF THE INVENTION

In order to meet the needs and overcome the problems as described above, an anti-roll clip for handbells has been devised to aid the support of the handbell when resting on the handbell table. The clip is a simple, wire device which attaches to the handle of the bell and, more particularly, to the circular hand guard portion of the handle. The clip contains two feet which contact the table top providing a stable support for the handbell. The grip of the clip around the hand guard is sufficient to keep the handbell from rotating within the clip under normal conditions. The clip wire material may be coated with an electrostatic powder coating of vinyl or the like to increase its non-slip quality and for abrasion resistence. By applying an additional force, the clip is rotatable around the hand guard so that an angular position of the handbell handle with respect to the table top can be selected and maintained.

Because the clip affixes to the hand guard which is of the same dimension for several different bell sizes, only 4 or 5 different size clips are required for all handbells in a complete set. Being resiliently deformable, the clips are also easily removable so that they will not interfere with handbell storage in cases which are molded to conform to the exact shape of the bells. When affixed to the handbells, the clips have sufficient grip and light weight so that there is no vibration created between the clip and the hand guard when playing the bell which might detract from the musical quality of the instrument. Therefore, the anti-roll clip can remain affixed to the bell throughout a musical performance. The utility of the present anti-roll clip is further enhanced by its design which allows it to be fitted to almost any handbell having a circular hand guard.

More specifically described, the anti-roll clip is formed from a single piece of resilient wire which has various bends and angles formed throughout its length as follows. The clip is symmetrical about a vertical axis having corresponding right and left sides. Each side has a top clamp formed by a U-shaped bend in the free end of the wire, a vertical arm extending substantially straight downward, a bottom clamp formed by another U-shaped bend at the bottom of the vertical arm, and a reverse direction bend beginning the top of an angled leg portion which proceeds downward and away from the vertical axis to an acute angle bend forming a foot. The wire then proceeds from the foot at a slightly upward angle creating a crossbar which interconnects the opposing portion of the clip at the vertical axis. The opposing side portion is essentially a mirror image of the first side just described and being a continuation of the same unitary piece of wire with corresponding bends formed therein.

DESCRIPTION OF THE PREFERRED EMBODIMENT

Figure 1:
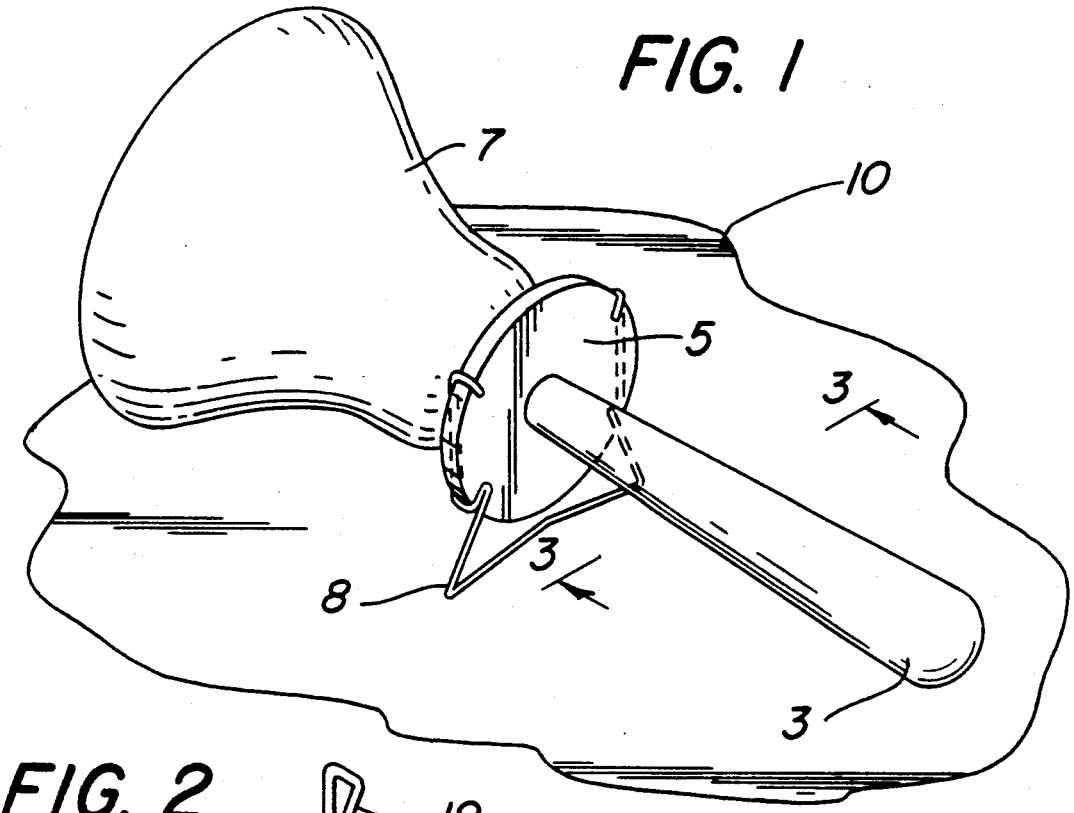
FIG. 1 is a top, left front isometric view of a handbell with the present anti-roll clip affixed thereto.

Referring now to FIG. 1, handbell 7 is shown resting on a suitable horizontal support, such as surface 10. The handbell includes the present anti-roll clip device 8 which is resiliently clipped around the circular hand guard 5. With the anti-roll clip in place, the handbell contacts the surface 10 at a point along the bottom of the mouth of the bell and at two points at the bottom corners of the anti-roll clip. Therefore, the bell and clip combination present a stable three-point stance on the support surface 10.

Figure 2:
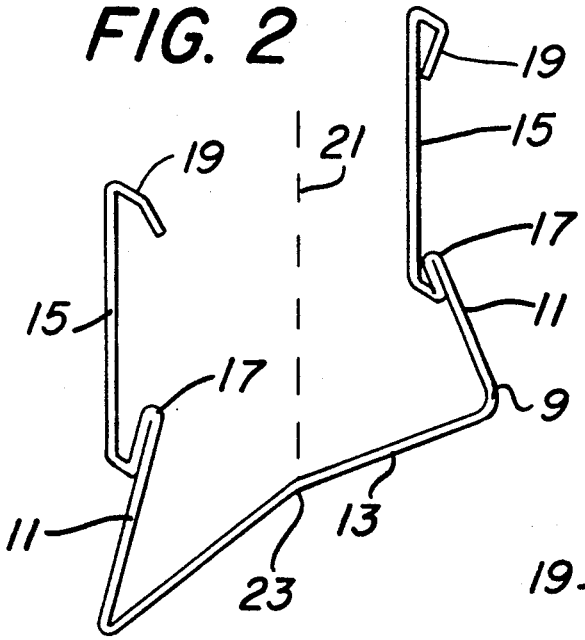
FIG. 2 is a top, left front isometric view of the anti-roll clip.

Referring now to FIG. 2, the anti-roll clip is formed from a single piece of resilient wire which has various bends and angles formed throughout its length. More specifically, the clip is symmetrical about a vertical axis 21 having corresponding right and left sides. Each side has a top clamp 19 formed by a U-shaped bend in the free end of the wire, a vertical arm 15 extending substantially straight downward, a bottom clamp 17 formed by another U-shaped bend at the bottom of the vertical arm, and a reverse bend 17 beginning the top of a angled leg portion 11 which proceeds downward and away from the vertical axis 21 to an acute angle bend 9 forming a foot to rest on a support structure, such as a table top. The wire then proceeds from the foot at a slightly upward angle forming a crossbar 13 which interconnects an opposing portion at vertical axis 21. The opposing side portion is essentially a mirror image of the first side just described and being a continuation of the same unitary piece of wire with the additional corresponding bends formed therein. The junction of both sides at point 23 creates a resilient hinge at that point between feet 9. Because of the various angled bends in the wire, the weight of the bell tends to spread the feet which, because of hinge 23, provides additional lateral gripping force between the clip and the hand guard.

Figure 3:
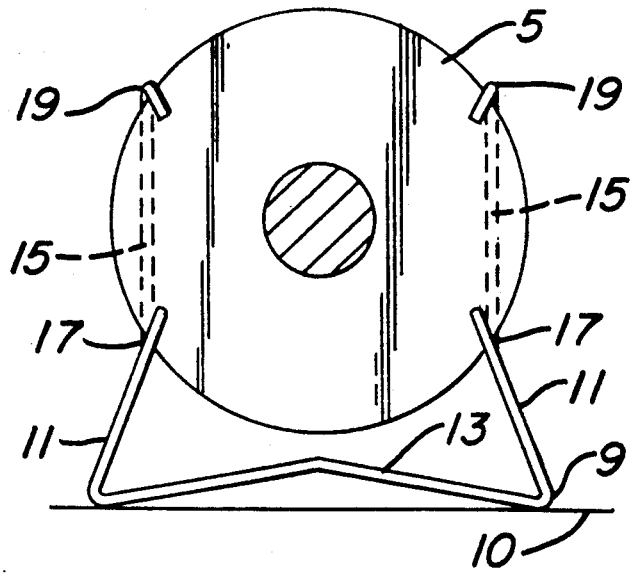
FIG. 3 is a front sectional view taken from FIG. 1 as shown in that figure.

Referring now to FIG. 3, a front view of the clip affixed to the handbell hand guard is shown. As depicted, handle 3 is held in an elevated position above the support surface 10 so that it may be conveniently grasped when it is picked up. The handbell hand guard is firmly gripped by the anti-roll clip which clips to the hand guard at points 19 and 17 on both right and left sides, resulting in a firm, four-point grip. The hand guard 5 is also axially gripped between the vertical arms 15 and the U-shaped bends at clamping points 19 and 17. Cross bar 13 contains a central apex bend at hinge point 23 which also provides inwardly directed spring force between the right and left sides to grip the hand guard laterally. The right and left legs 11 are at an inwardly directed angle so that the weight of the handbell by the force of gravity acting through hinge 23 creates additional lateral gripping pressure at points 19 and 17 on each side. The clip wire material is preferably coated with an electrostatic powder coating of vinyl or the like to increase its non-slip quality and for abrasion resistence.

By the mechanical relations described above and the use of resilient wire to form the anti-roll clip, it will be readily understood by those of ordinary skill in the mechanical arts that the present device provides a forcible grip on the handbell hand guard both axially and laterally. It will also be readily understood that the handbell may be released from the clip by simply spreading the right and left sides of the clip, thereby releasing the hand guard from between the top and bottom clamping portions on the right and left sides. The use of a thin, light weight metal wire not only allows economical manufacture, but makes the mass of the device extremely low which enables the resilient grip of the spring to firmly hold the stand against vibration during bell ringing.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. An anti-roll stand for a handbell, comprising:

a. a handbell having a circular hand guard; and b. a stand having a base and a vertically-extending portion connecting said base with a top portion having resilient gripping means which firmly affix said stand to said handbell.

2. The stand of claim 1, wherein said gripping means engages the hand guard on said handbell.

3. The stand of claim 2, wherein said gripping means is releaseable and forcibly engages said hand guard, both laterally and axially.

4. The stand of claim 3, wherein said hand guard is axially gripped by U-shaped clamps formed in the vertically extending portion of said stand, said stand being composed of a resiliently deformable material.

5. The stand of claim 4, wherein said gripping means are aided by the lateral gripping force which is supplied by the force of gravity acting through a resilient hinge located between two feet on said base and is further supplied by the spring force of said hinge.

6. The stand of claim 5, wherein said stand is of unitary construction.

7. The stand of claim 6, wherein said stand is formed by bends in a metal wire.

8. The stand of claim 7, wherein said feet are formed by acute angle bends in said wire.

9. The anti-roll stand of claim 8, further including a coating of friction-increasing material.

10. An anti-roll stand for a handbell, comprising; a handbell having a circular hand guard which is held against rolling laterally on a horizontal surface by an anti-roll clip which is affixed to said hand guard, said anti-roll clip formed from a single piece of resilient wire with bends and angles formed throughout its length symmetrical about a vertical axis having mirror image right and left sides, each side having a top clamp formed by a U-shaped bend in the free end of the wire, a vertical arm extending substantially straight downward, bottom clamp formed by another U-shaped bend at the bottom of the vertical arm, and a reverse direction bend beginning at the top of an angled leg portion which proceeds downward and away from the vertical axis to an acute angled bend forming a foot, said wire then proceeding from said foot at a slightly upward angle creating a crossbar which interconnects the opposing side portion of the clip at the vertical axis.

* * * * *